United States Patent [19]

Saito

[11] Patent Number: 5,049,934

[45] Date of Patent: Sep. 17, 1991

[54] IMAGE FORMING APPARATUS HAVING IMAGE TRANSFER MEANS

[75] Inventor: Rie Saito, Yokohama, Japan

[73] Assignee: Canon Kabushiki Kaisha, Tokyo, Japan

[21] Appl. No.: 573,683

[22] Filed: Aug. 28, 1990

[30] Foreign Application Priority Data

Aug. 31, 1989 [JP] Japan ..... 1-225349

[51] Int. Cl.[5] ..... G03G 21/00

[52] U.S. Cl. ..... 355/219; 355/222; 355/223; 355/296; 355/327

[58] Field of Search ..... 355/219, 296, 297, 299, 355/301, 303, 305, 309, 316, 221, 222, 223, 225, 326, 327

[56] References Cited

U.S. PATENT DOCUMENTS 4,252,433 2/1981 Sullivan .
4,378,421 3/1983 Larson .
4,804,999 2/1989 Mueller .

*Primary Examiner*—R. L. Moses
*Attorney, Agent, or Firm*—Fitzpatrick, Cella, Harper & Scinto

[57] ABSTRACT

An image forming apparatus includes an image bearing member movable along an endless path; primary charger for electrically charging the image bearing member for formation of latent image thereon; a developing device for developing the latent image with toner into a toner image; transfer charger for transferring the toner image onto a recording material; a discharger, disposed between the transfer charger and the primary charger and actable directly on the image bearing member not through the recording material after the toner image is transferred from the image bearing member to the recording material, for effecting electric discharge biased to a polarity opposite to a charging polarity of the transfer charger, wherein a degree of the bias to the opposite polarity is larger for a first portion of the image bearing member corresponding to a trailing edge of the recording material than for a second portion which is different from the first portion.

48 Claims, 9 Drawing Sheets

IMAGE FORMING APPARATUS HAVING IMAGE TRANSFER MEANS

FIELD OF THE INVENTION AND RELATED ART

The present invention relates to an image forming apparatus such as an electrophotographic copying machine or electrophotographic printer, which is provided with image transfer charger means for transferring an image from an image bearing member onto a recording material.

Referring first to FIG. 3, there is shown an example of a color image forming apparatus, in which the image formation process includes an image transfer step. The brief description will be made using this Figure as to the image forming process. An image bearing member 1 having a photosensitive layer of amorphous silicon, OPC (organic photoconductive) or the like is uniformly charged by a primary charger 2 and is exposed to a color-separated light image 3, so that an electrostatic latent image is formed thereon.

The electrostatic latent, image thus formed is developed with a magenta toner by a developing device 5M and then is transferred onto the recording material (transfer material) P on a recording or transfer material carrying member 20 by a transfer charger 6.

Then, a cyan color toner image is formed by the developing device 5*c* on the image bearing member through the similar process, and the toner image is transferred onto the same transfer material P.

Similarly, the transfer material P receives yellow and black toner images sequentially provided by the developing devices 5Y and 5BK, respectively.

The transfer material now carrying the unfixed toner image is carried on the transfer material carrying means and is subjected to the discharging operation by an outer discharger 7 and an inner discharger 8. Then, the transfer material is separated from the transfer material carrying means by a separation discharger 9 and a separation pawl 10, and is conveyed to an image fixing device 11 by means of which the color toners are mixed and fixed thereon. Then, the transfer material is discharged with the full-color image thereon. The toner remaining on the image bearing member after the image transfer is not necessary for the next process, and therefore, is removed by a cleaner 30.

A discharger 40 applies an AC corona current to the image bearing member.

FIG. 4 illustrates the electric charge on the photosensitive drum in the image formation process. Where, for example, the latent image is constituted by negative electric charge, and the toner of the developer is negatively charged to reverse-develops the latent image, the polarity of the transfer current provided by the transfer charger 6 is set to be positive polarity which is opposite to the charging polarity of the primary charger 2. Then, positive charge is induced on the surface of the transfer material through the transfer material carrying sheet 201 and the transfer material P. The illustration is on the basis of the assumption that a transfer drum (the transfer material carrying member) having a diameter of 160 mm is contacted to the photosensitive drum having a diameter of 80 mm; that the size of the transfer material is A3; and that after a toner image of a certain color is transferred onto the transfer material P carried on the transfer drum 20, the transfer material P is not separated and is kept wrapped on the transfer drum to receive the next color toner image.

As shown in FIG. 6, the transfer charger is rendered off at a trailing edge of the transfer material in the first color image transfer, and is rendered on at the leading edge of the transfer material in the second color image transfer. The surface potential of the portion of the photosensitive drum downstream of the transfer position is different depending on whether it is subjected to the image transfer current in the first color image transfer step or not. More particularly, only the portion that has been subjected to the transfer current is positively biased.

The potential difference results in non-uniformity of the second color image, and therefore, the photosensitive drum is electrically discharged by a pre-exposure lamp 50.

However, it is not easy to completely remove the positive charge by the light where the photosensitive member has a negative charging property, and in consideration thereof, the discharger 40 is used to discharge it, the discharger 40 being disposed before the cleaner and producing an AC corona current.

The multi-color electrophotographic copying machine having the above described structure operates in good order, but the inventor's experiments and investigations have revealed that a problem arises particularly when the transfer drum 20 has a transfer material carrying sheet 201 made of a dielectric material film such a polyfluorinated vinylidene resin film, and the transfer material P is of paper, further particularly when the humidity of the ambience is large.

In the above case, the volume resistivity of the film is $10^{13}$ ohm.cm, and the volume resistivity of the transfer sheet is $10^{9}$ (high humidity (85%)) – $10^{12}$ (low humidity (10%)) ohm.cm. Then, the positive charge from the transfer charger 6 is injected into the transfer material P through the transfer material carrying sheet 201 and is accumulated in the surface region of the transfer material P at the trailing edge portion P*a*.

It has further been found that the positive charge accumulated in the surface region at the trailing edge portion P*a* produces a strong electric field in cooperation with the surface of the photosensitive drum, so that, as shown in FIG. 5, separation discharge occurs when the trailing edge portion P*a* is separated from the photosensitive drum 1, that the negative charge in the air moves toward the transfer material P by the positive charge on the transfer material P, that the positive charge in the air moves to the photosensitive drum 1 negatively charged, and that a stripe of damage is given to the photosensitive drum 1 along the trailing edge of the transfer material P, in other words, a memory effect is produced on the photosensitive drum 1. This remains as a drum memory as shown in FIG. 7 which shows the operational sequence of the latent image formation, development and image transfer relative to the number of revolutions of the photosensitive drum and the transfer drum in a conventional image forming apparatus. The memory effect reduces an amount of primary charge on the photosensitive drum 1 by the primary charger 2 along a line parallel with an axis of the photosensitive drum 1, thus deteriorating the uniformity of the electric charge of the photosensitive drum and results in reception of the toner in the image background area and in non-uniform image.

SUMMARY OF THE INVENTION

Accordingly, it is a principal object of the present invention to provide an image forming apparatus wherein the transfer memory in the image bearing member is removed to assure a high quality image.

It is another object of the present invention to provide an image forming apparatus providing good images irrespective of the ambient conditions of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
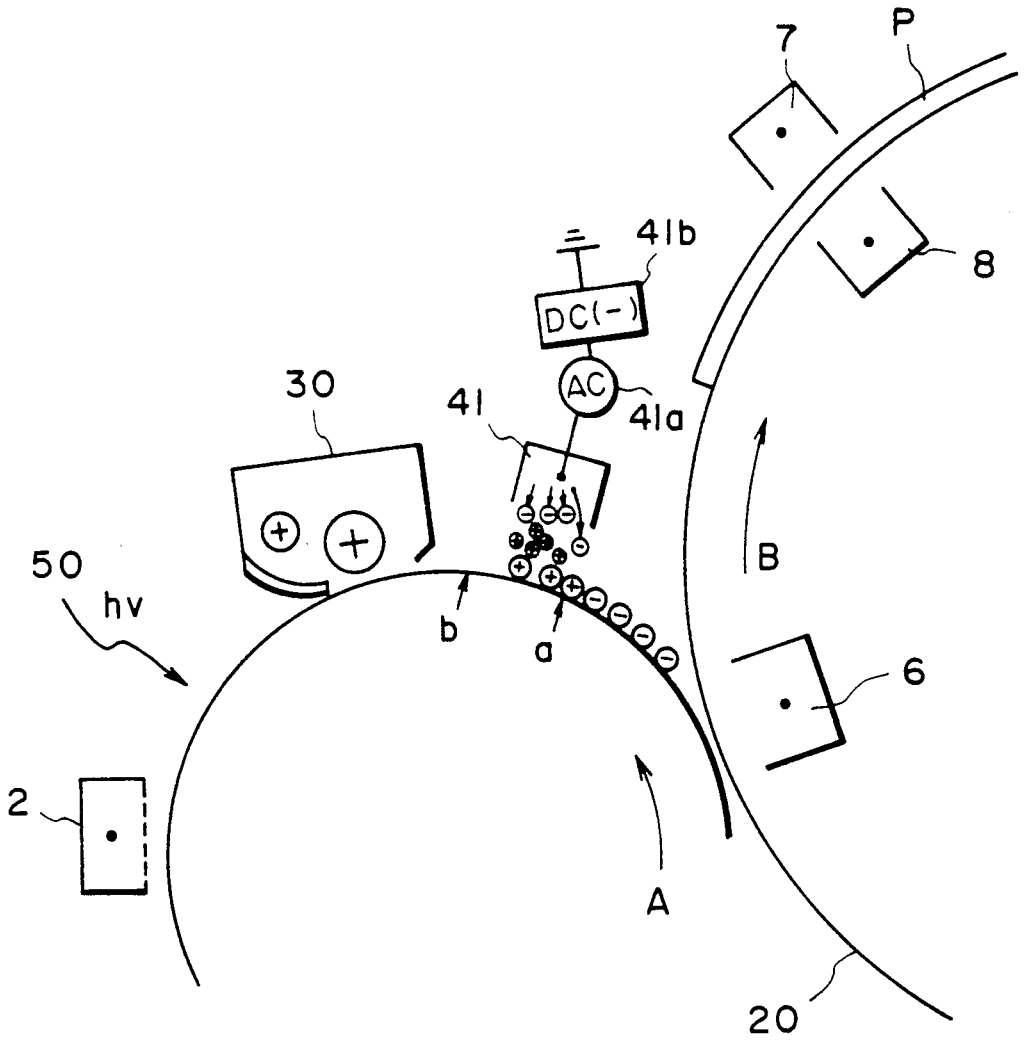
FIG. 1 is a sectional view of an image forming apparatus according to an embodiment of the present invention.

Referring to the accompanying drawings, the description will be made as to the preferred embodiments of the present invention. In the drawings, the same reference numerals are assigned to the elements having the corresponding functions.

Figure 3:
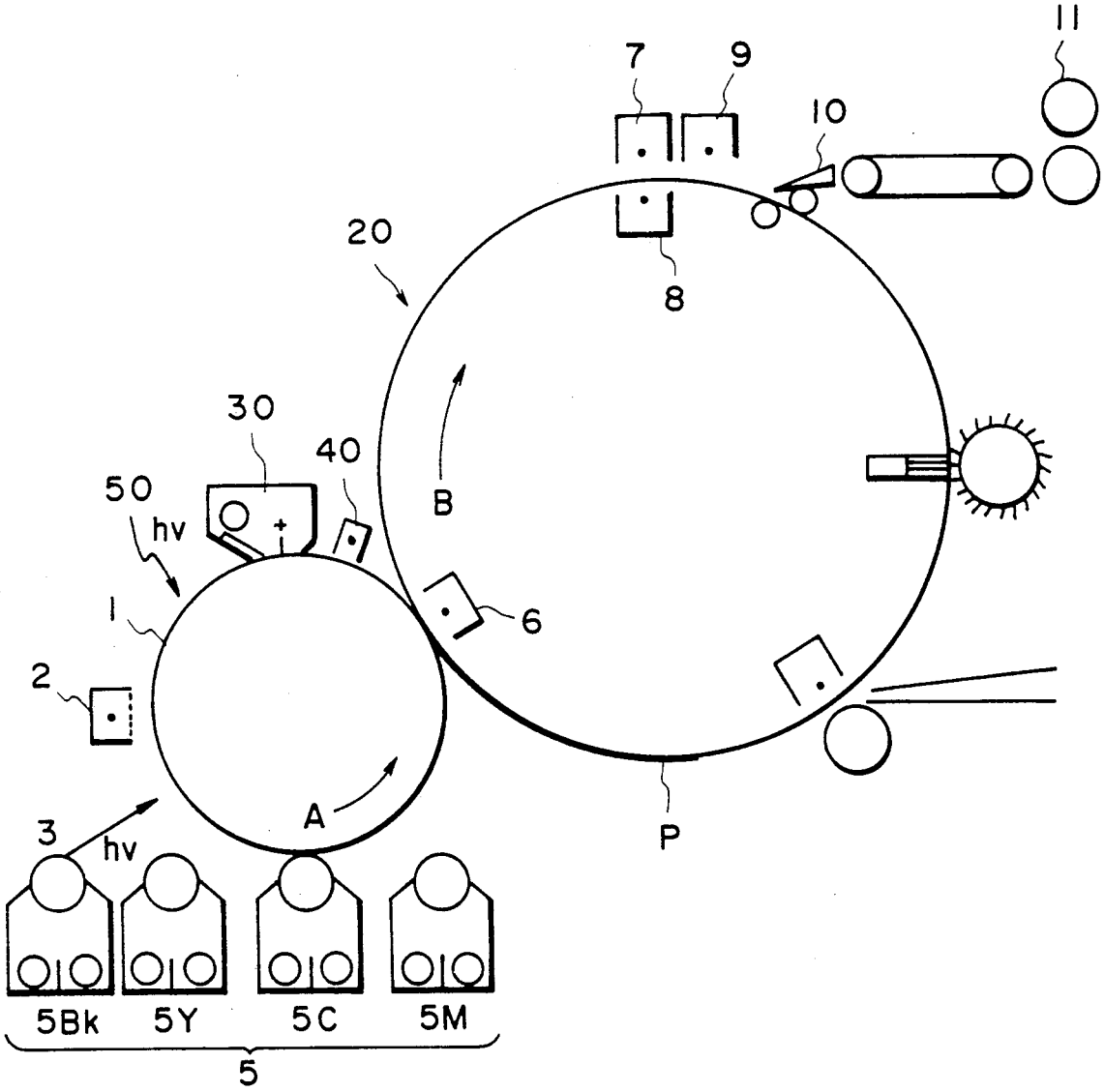
FIG. 3 is a sectional view of an example of an image forming apparatus.
Figure 4:
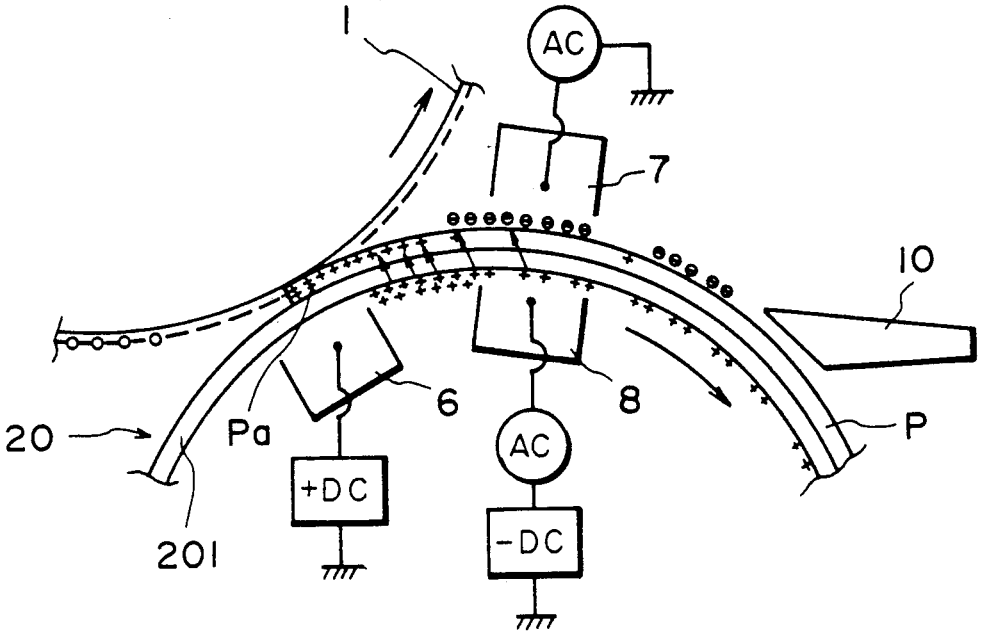
FIGS. 4 and 5 are enlarged views of an image transfer station for explaining a problem in the apparatus of FIG. 3.
Figure 5:
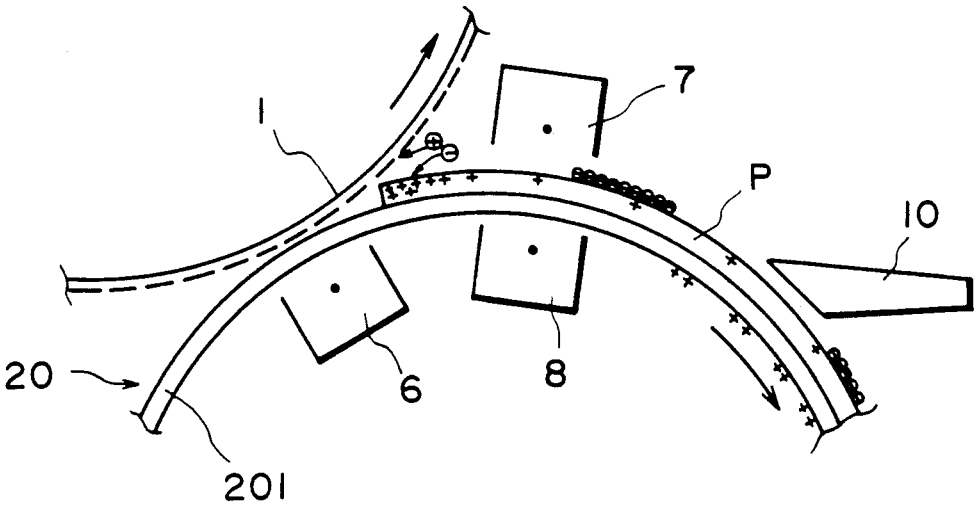

FIG. 1 is a sectional view of a full-color image forming apparatus as an exemplary image forming apparatus according to an embodiment of the present invention. The structure thereof is the same as that of FIG. 3 described in the foregoing with the exception of a discharger 41.

The photosensitive member 1 (image bearing member) in the form of a drum having a diameter of 80 mm has a surface layer of organic photoconductive material having a negative charging polarity. It is rotatable along an endless path in the direction indicated by an arrow A. The photosensitive member 1 is uniformly charged to a negative polarity (−560 V) by a primary charger 2 while it is being rotated in the direction A. It is then, exposed to a color-separated light image in accordance with image information by exposure means such as a laser scanner, so that an electrostatic latent image is formed. The negative latent image thus formed on the photosensitive member is reverse-developed by the developing device 5M with the magenta toner which has been charged to the negative polarity which is the same polarity as the charging polarity of the primary charger 2, by which the portion of the photosensitive member where the surface potential is reduced by the light projection to −120 V receives the toner. The leading edge of the developed magenta toner image is timed with a leading edge of the recording material (transfer material) P such as paper at an image transfer position where the photosensitive member and the transfer charger 6 are faced to each other. The transfer paper is carried on the recording material carrying means in the form of a transfer drum having a diameter of 160 mm. The magenta toner image is transferred from the photosensitive member 1 to the transfer material.

In the similar manner, another toner image is formed on the photosensitive member 1 by the developing device 5*c* with the cyan toner negatively charged, and the toner image is superposedly transferred onto the transfer material P.

Further similarly, the transfer material P receives the yellow toner image formed on the photosensitive member 1 by the developing device 5Y and then the black toner image formed on the photosensitive member 1 by the developing device 5BK. The toner in this embodiment is non-magnetic toner contained in the developer together with the magnetic carrier particles in the developing device.

In this manner, the transfer material P now has an unfixed toner image with chromatic (magenta cyan and yellow) toners and non-chromatic (black) toner, and is carried on the transfer drum 20 to be electrically discharged by the outer discharger 7 and the inner discharger 8. Thereafter, it is discharged by a separation discharger 9 and is separated from the transfer drum 20 by the separation pawl 10. The unfixed toner images are mixed and fixed by the fixing device 11, and then, the transfer material P is discharged from the apparatus.

The photosensitive member 1, after the image transfer operation, is electrically discharged by the discharger 41 after each of the image transfer operations. Then, the residual toner is removed by the cleaner 30. The photosensitive member is subjected to the whole surface exposure 50 by a pre-exposure lamp so as to be prepared for the next color image formation.

The transfer charger 6 is supplied with a positive DC voltage of 6–9 KV, and the transfer current is +100–+500 micro-ampere. The polarity of the voltage is opposite to the charging polarity of the photosensitive member 1, that is, the charging polarity of the primary charger 2.

Figure 6:
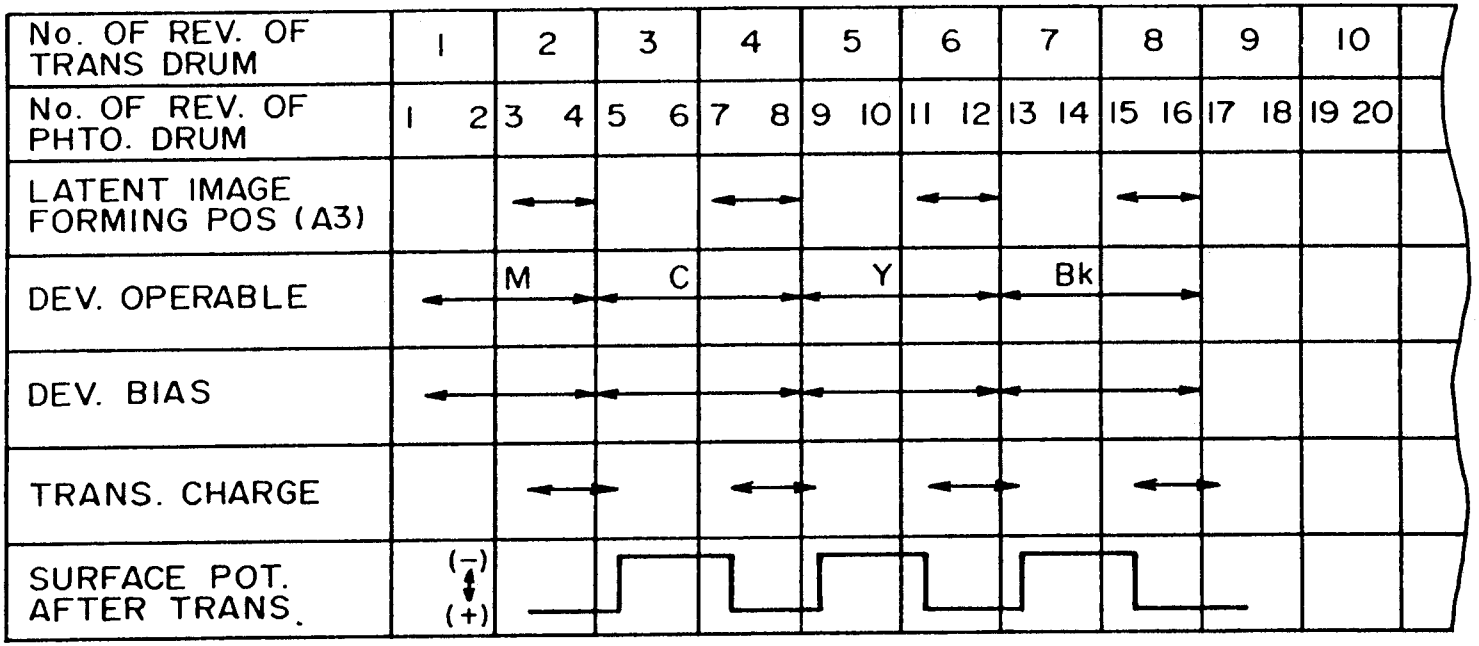
FIGS. 6 and 7 are timing charts for the apparatus of FIG. 3.
Figure 7:
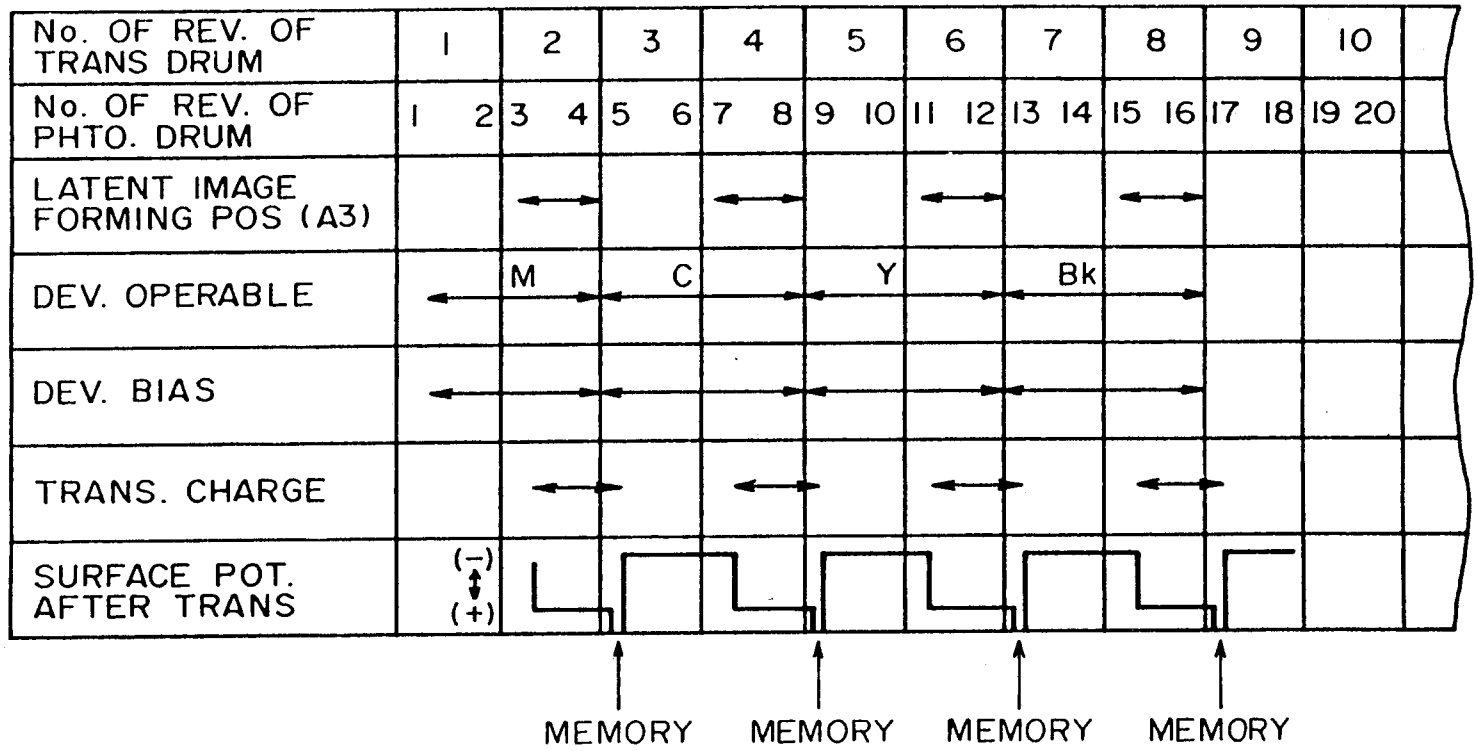

As described in the foregoing, the transfer charger 6 operates only during the period in which the transfer material P exists at the transfer position, as shown in FIG. 6. The transfer drum 20 has ring portions at its longitudinal opposite ends, a connector for connecting the ring portions and a transfer material carrying sheet 201 covering the opening defined by the rings and the connector. The transfer drum 20 is rotatable in a direction B along an endless path. On the transfer material carrying sheet 201, the transfer material P is supported. The carrying sheet 201 is made of dielectric film such as polyfluorinated vinylidene resin film. The film has a thickness of 100–175 microns and a volume resistivity $10^{13}$–$10^{15}$ ohm.cm. The volume resistivity of the usable film is not less than $10^{8}$ ohm.cm.

The transfer drum 20 is disposed with a gap from the photosensitive member 1, the gap being smaller than the thickness of the transfer material P, so that when the transfer material P is present at the transfer position during the image transfer operation, the photosensitive member 1 and the transfer material P are contacted to each other.

FIG. 1 is a sectional view when the position on the photosensitive drum corresponding to the trailing edge of the transfer sheet comes to the discharge position where the discharger 41 is faced to the photosensitive member 1, after the transfer sheet P has received the first color (magenta) toner image transfer and has passed through the transfer position. At this time, there is no sheet between the photosensitive drum and the discharger 41. The photosensitive member has an organic photoconductive layer (OPC). The position of the photosensitive drum corresponding to the trailing edge of the transfer sheet is strongly charged to the positive polarity with the result of transfer memory, because of the separation discharge which is considered as being attributable to the strong electric field by the positive charge accumulated at the trailing edge of the transfer sheet.

The discharger 41 is disposed downstream of the image transfer charger 6 and upstream of the primary charger 2, more particularly, upstream of the cleaner 30 in this embodiment, and is connected electrically with an AC source 41*a* and a negative DC source 41*b*.

Figure 2:
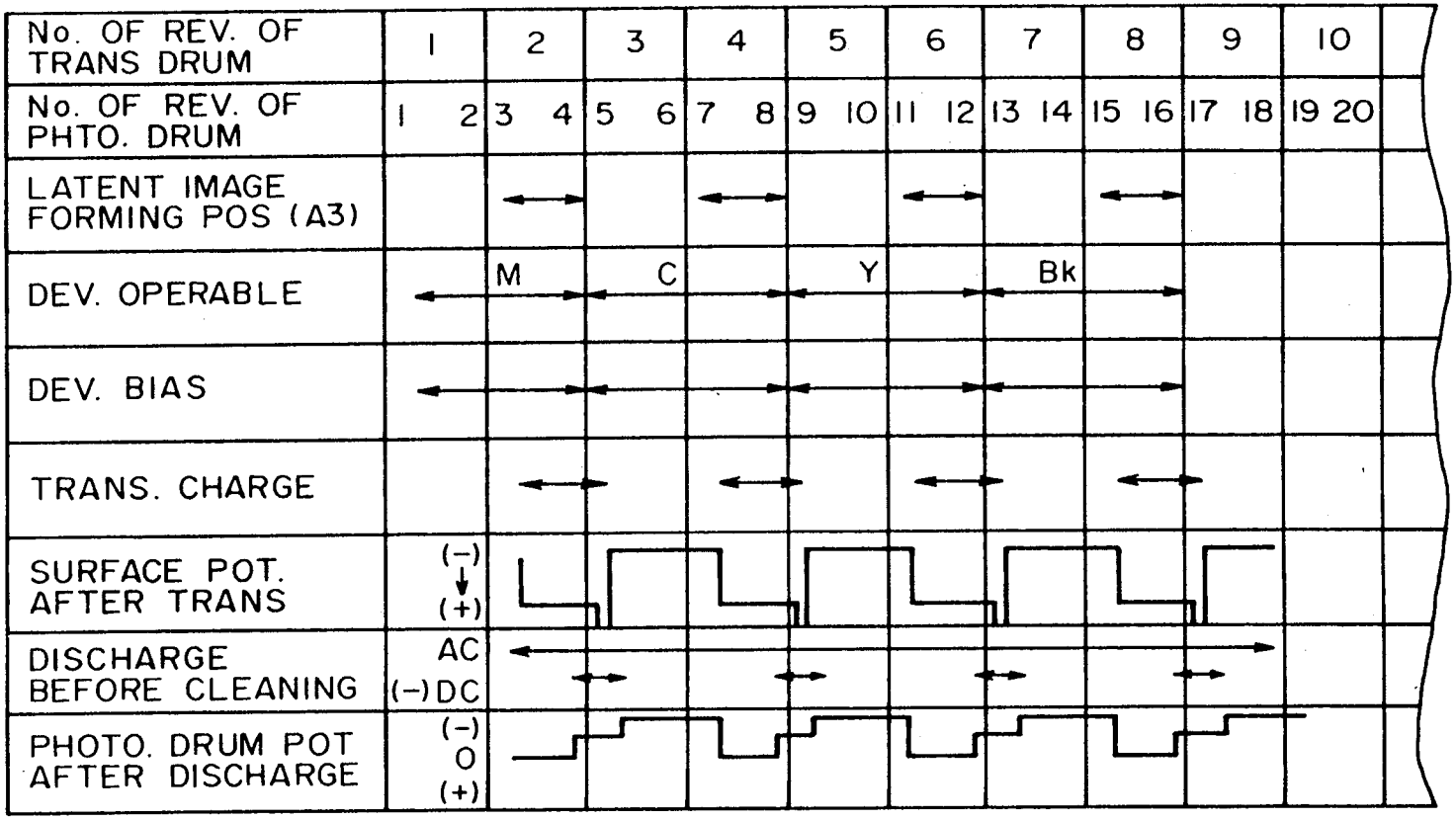
FIG. 2 is a timing chart illustrating an operation of the apparatus.

As shown in FIG. 2, the AC current of the discharger 41 is kept energized throughout the sequential operation, the AC current being effective to remove weak transfer memory produced at the leading edge of the transfer sheet o the central part of the transfer sheet, for example. In addition, it is effective to electrically discharge the residual toner and the photosensitive member by which the attraction force of the residual toner is reduced to assist the cleaning operation.

To the portion a of the photosensitive member corresponding to the trailing edge of the transfer sheet where the strong transfer memory is retained, a negative DC current is supplied by the DC source 41*b* in addition to the AC current. By doing so, the discharge current is biased to the polarity opposite to the polarity of the transfer charge.

The strong positive charge of the drum surface portion a provided by the separation discharge is neutralized by the negative DC component supplied by the discharger 41. On the surface portion b after being subjected to the discharge is substantially completely discharged. Here, the discharging effect was best when the peak-to-peak voltage $V_{pp}$ of the AC current was 7-14 KV, and the DC current was 0--200 micro-ampere.

As best seen in FIG. 2, the negative DC current is supplied only when the portion of the photosensitive member substantially corresponding to the trailing edge of the transfer sheet is at the discharging position. Thus, the amount of bias of the discharge toward the polarity opposite to the transfer charge polarity is larger in the first portion of the photosensitive member corresponding to the trailing edge of the transfer sheet than in the other (second) portion, the bias in the second portion being substantially zero in this embodiment.

As described in the foregoing, the weak transfer memory (potential difference) is eliminated by the AC current, and the memory at the sheet trailing edge position which is not removed by the AC current, is removed by the negative DC current.

The surface potential of the photosensitive drum having been subjected to the discharge of the discharger 41 is partly biased to the negative polarity, as shown in FIG. 2. However, it is completely removed by the subsequent pre-exposure 50, and therefore, no problem arise therefrom.

The timing of the DC current application by the discharger when the portion corresponding to the sheet trailing edge is at the discharge position, has empirically been confirmed to be preferable ±5-50 mm from the position exactly corresponding to the trailing edge of the transfer sheet. In some case, the memory remains in the portion corresponding to the leading edge of the transfer sheet, too. In consideration of this, the DC current may be supplied by the discharger when such a portion is at the discharging portion.

In this embodiment, as described in the foregoing, the negative DC current is supplied by the discharger 41 to the portion corresponding to the sheet trailing edge where the separation discharge has occurred, so that the electric charge is completely removed from the photosensitive member, by which the drum memory can be removed, so that good images are produced.

However, on the photosensitive drum after the image transfer operation, the residual toner may remains, which is weakly charged to the negative polarity. When the negative DC component discharge is supplied to the residual toner, it is strongly charged to the negative polarity. When this occurs, the portion of the toner having been subjected to the negative DC current is strongly attracted to the photosensitive drum. Therefore, it imposes higher load to the cleaner in the subsequent cleaning step. Under a high temperature and high humidity conditions (32.5° C. and 85%), the electric charge of the toner is not significant when the toner reaches the position where the cleaning blade of the cleaner is contacted to the photosensitive member. Therefore, the problem is not very significant. However, under the low temperature and low humidity conditions (15° C., 10%), the toner is strongly charged with the result of improper cleaning operation.

In consideration of this, the application of the negative DC current is limited to the portion corresponding to the trailing edge of the transfer sheet. Still, however, the load of the cleaning means for this portion is large. The strong drum memory by the separation discharge of the transfer sheet as described above is tough under the high temperature and high humidity conditions, since then the transfer sheet absorbs moisture to have low resistivity, so that the electric charge on the transfer sheet is easily moved to the trailing edge of the sheet, as has been found by the inventor.

Figure 8:
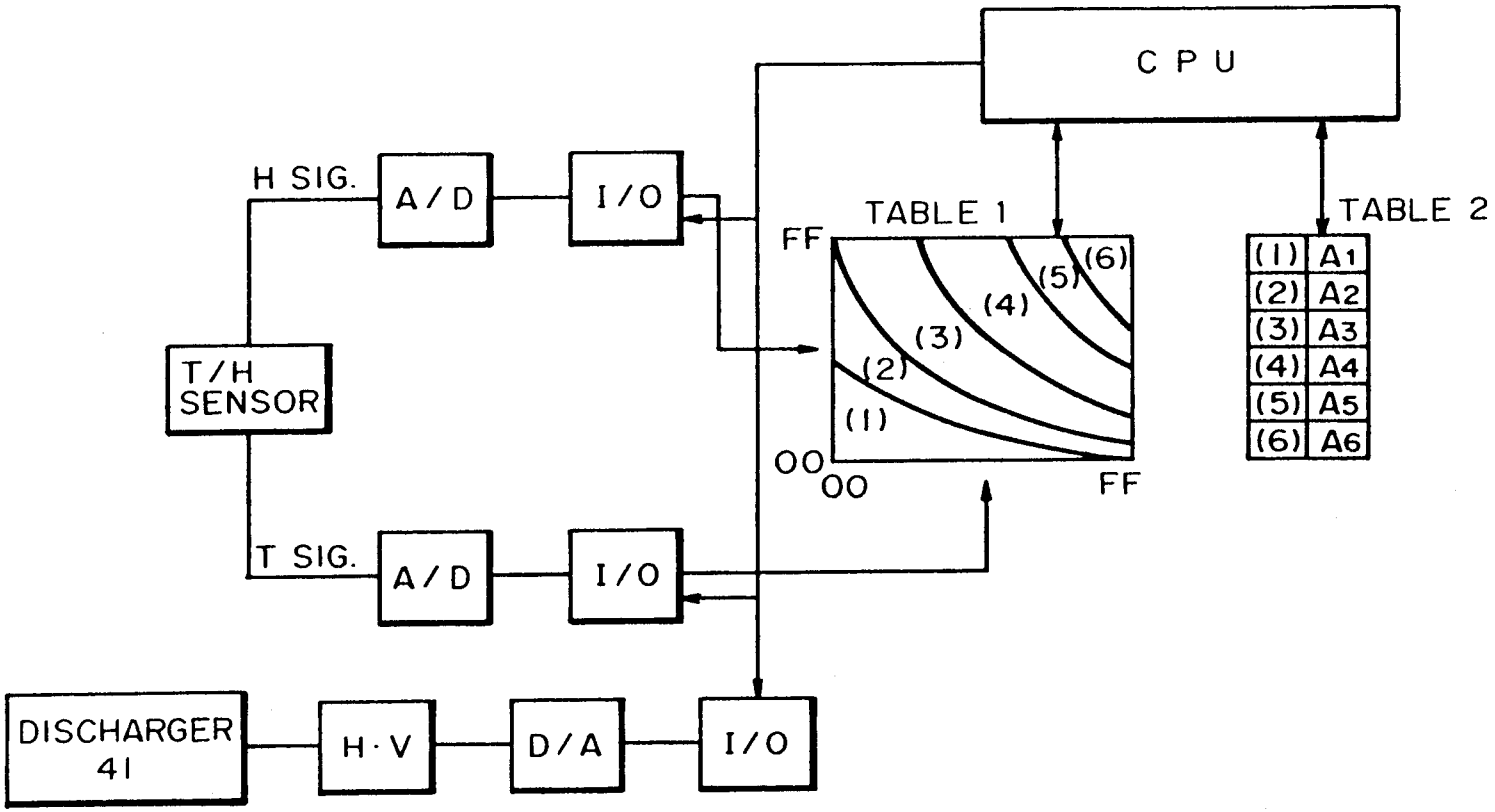
FIG. 8 is a block diagram of a control system for an image forming apparatus according to a second embodiment of the present invention.

Referring to FIG. 8, the description will be made with respect to another embodiment of the present invention. In this embodiment, the negative DC current of the pre-cleaning discharge is controlled on the basis of the ambience under which the apparatus is used.

FIG. 8 is a block diagram of the control system in this embodiment. Adjacent to a periphery of the photosensitive drum, a temperature and humidity sensor 42 is disposed. The sensor produces a temperature signal T and a humidity signal H, which are digitalized by an A/D converter and are supplied to the I/O port. The two signals from the I/O port are compared with a table 1, and one of the regions (1)-(6) is selected. When the region is selected, a table 2 is used through the CPU. Then, a signal indicative of a discharge current is read from the table 2. The signal is converted to an analog signal by a D/A converter through the I/O port by the CPU. Then, it is supplied to the high voltage source for the discharger 41, so that the selected output is produced. In this embodiment, the DC current component of the discharger 41 is controlled.

The above-described series of operations is performed prior to the copying operation, by the CPU.

Figure 9:
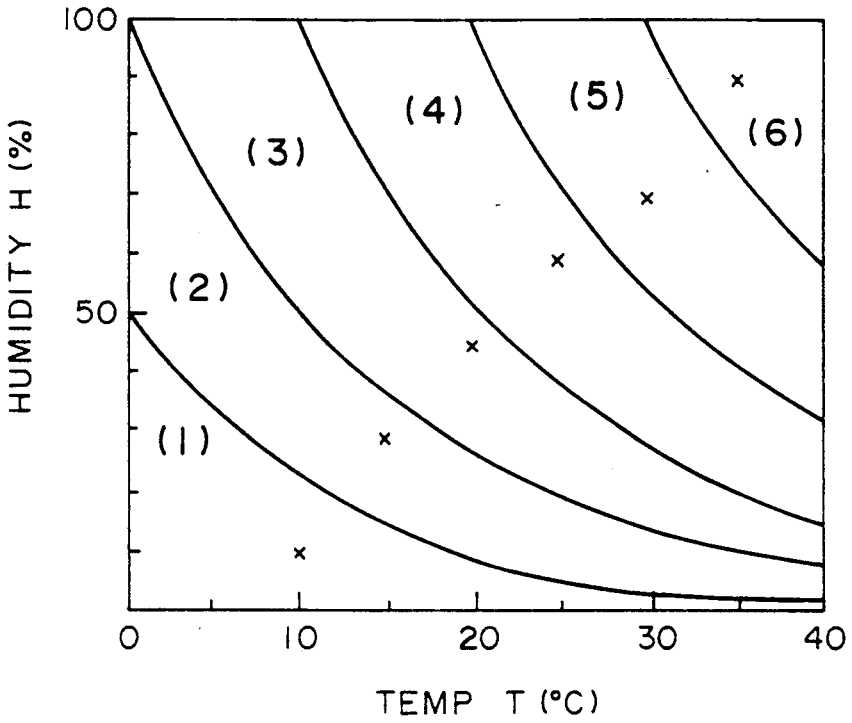
FIG. 9 is a graph giving an amount of water in the apparatus of the second embodiment.

The regions (1)-(6) of FIG. 9 are defined by constant water content curves. In any one of the regions, the charging property of the toner, the charging property of the transfer material, the moisture absorbing property of the transfer material carrying sheet and the charging property thereof are substantially equal, and therefore, the apparatus is under the same ambient conditions in use.

Figure 10:
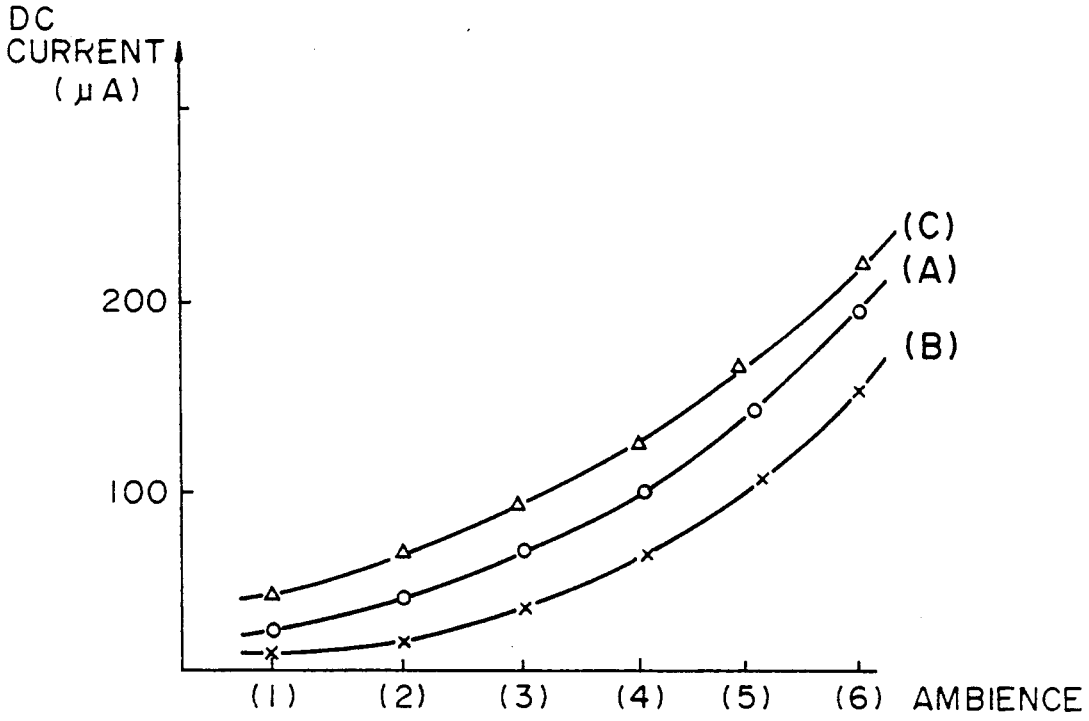
FIG. 10 shows data in table 2 in an embodiment of the present invention.

In this manner, a region in which the water content in the air is substantially constant is designated on the basis of the sensor outputs of humidity and temperature. On the basis of the designated region, the negative DC current by the discharger 41 is controlled, by which the drum memory at the trailing edge of the sheet can be controlled in accordance with the volume resistivity change due to the moisture absorption of the transfer material and the surface resistance change of the dielectric film. Referring to FIG. 10, a curve (A) is plots of proper transfer current relative to representative temperatures and humidities. The Table 2 shown in FIG. 8 is based on the currents given by the curve (A) of FIG. 10.

As will be understood, the DC current is decreased with decrease of temperature and with decrease of humidity, and therefore, the electric charge of the toner is decreased therewith, so that the insufficient cleaning can be prevented.

Under the low temperature and low humidity conditions, the transfer memory is not large, so that the transfer memory can be assuredly removed even if the electric current is reduced.

The number of regions (FIG. 9) may be increased or decreased as desired by one skilled in the art. In the foregoing embodiment, both of the temperature and the humidity are taken into account, but it is possible that only one of them is taken into account, although it is preferable that both are considered.

In this embodiment, the region of the ambient conditions under which the apparatus is used is selected on the basis of the outputs of the temperature and humidity sensor, and the DC current corresponding thereto is produced on the basis of tables through the CPU. By doing so, the drum memory is reduced, and simultaneously, the improper cleaning can be avoided. However, the transfer sheet has different moisture absorption characteristics, depending on the material thereof, and the volume resistivity is different depending on the same, so that the drum memory is different depending no them. When the transfer current is also controlled in accordance with the ambient conditions, the drum memory is significantly different depending on the transfer current.

In a third embodiment, the DC current of the discharger can be changed for the respective ambient conditions, in addition to the structure of the second embodiment.

Figure 11:
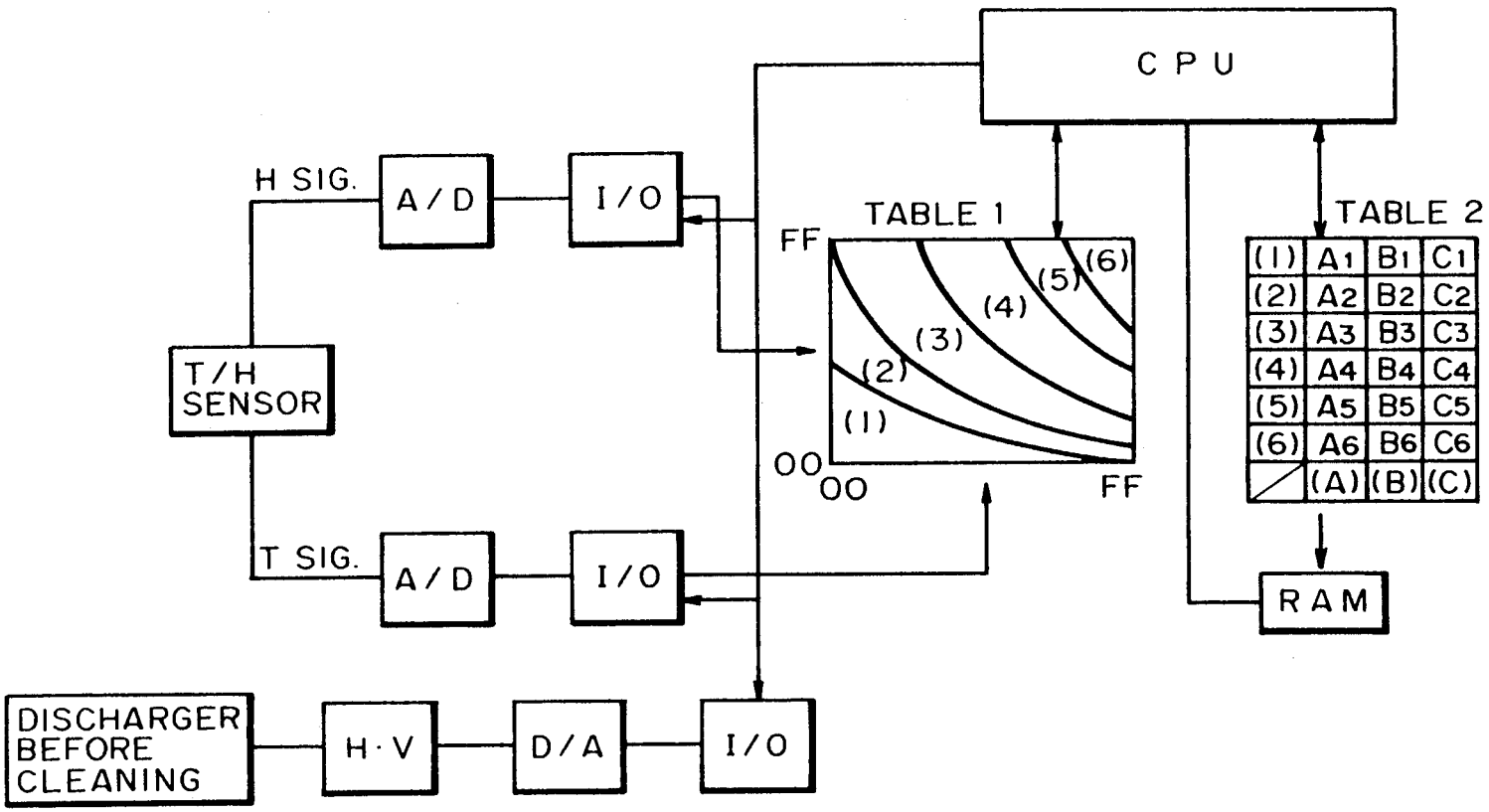
FIG. 11 is a block diagram for an apparatus according to a third embodiment of the present invention.

Referring to FIG. 11 which is a block diagram, the third embodiment will be described. The control system includes a RAM for reading and storing the data of Table 2. For example, when no designation is made, a series of (A) data is stored for the ambient conditions (1)-(6) during the copy sequential operation. When the used transfer sheet has a large volume resistivity, or when the drum memory is in significant, (b) data can be selected by the user or the service men. Similarly, when the used sheet has a small volume resistivity or when the drum memory is significant, the (c) data can be selected thereby. The table data under various ambient conditions are shown in FIG. 10.

In the foregoing embodiments, a full-color image is formed on a transfer material using a transfer drum. However, the present invention is not limited to this case, but is applicable to the structure in which a single color image is formed on the transfer material without use of the transfer drum. The present invention is particularly effective when a two component developer is sued, since then the toner is easily charged, and therefore, the memory easily occurs, irrespective of whether a multi-color or single color image is formed.

In the foregoing embodiment, a DC voltage and an AC voltage are supplied to the discharger 41, but it is possible that only an AC voltage is applied. In this case, the peak-to-peak voltage of the AC voltage is made different for the portion of the photosensitive member corresponding to the trailing edge of the sheet than for the other portion.

The wave form of the AC voltage in any of the embodiments, is not limited to a sine wave form, but may be a triangular, rectangular or the like form, if positive and negative voltages appear alternatively.

As described in the foregoing, according to the present invention, both of the weak transfer memory and the strong transfer memory can be avoided, and therefore, high quality images can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member movable along an endless path;

primary charging means for electrically charging said image bearing member for formation of a latent image thereon;

developing means for developing the latent image with toner into a toner image;

transfer charging means for transferring the toner image onto a recording material;

discharging means, disposed between said transfer charging means and said primary charging means and actable directly on said image bearing member not through the recording material after the toner image is transferred from said image bearing member to the recording material, for effecting electric discharge biased to a polarity opposite to a charging polarity of said transfer charging means, wherein a degree of the bias to the opposite polarity is larger for a first portion of said image bearing member corresponding to a trailing edge of the recording material than for a second portion which is different from the first portion.

2. An apparatus according to claim 1, wherein said discharging means is supplied with a DC voltage which is higher when the first portion is at a discharge position where said discharging means is actable than when the second portion is at the discharging position.

3. An apparatus according to claim 2, wherein said discharging mean is supplied with a DC voltage only when the first portion is at the discharging position.

4. An apparatus according to claim 2, wherein said discharging means is supplied with an AC voltage component and a DC voltage component.

5. An apparatus according to claim 4, wherein said discharging means is supplied with both of the AC voltage component and the DC voltage component when the first portion is at the discharging position, and said discharging mean is supplied only with the AC voltage component when the second portion is at the discharging position.

6. An apparatus according to claim 1, further comprising control means for controlling the degree of bias in accordance with an ambient condition under which said apparatus is operated.

7. An apparatus according to claim 6, further comprising detecting means for detecting a temperature and/or humidity as the ambient condition.

8. An apparatus according to claim 1, further comprising cleaning means for removing residual toner from said image bearing member after an image transfer operation by said transfer charging means, and said discharging means is disposed between said transfer charging means and said cleaning means.

9. An apparatus according to claim 1, wherein said image bearing member has a photosensitive layer of organic photoconductor.

10. An apparatus according to claim 1 or 9, wherein said transfer charging means has a charging polarity which is opposite to a charging polarity of said primary charging means.

11. An apparatus according to claim 10, wherein a polarity of electric charge constituting the latent image is the same as a charge polarity of the toner.

12. An apparatus according to claim 1, wherein the first portion of said image bearing member extends from a portion of said image bearing member which corresponds to the trailing edge of the recording material at the time of image transfer operation by said transfer charging means, toward upstream and downstream with respect to a movement direction of said image bearing member.

13. An apparatus according to claim 1 or 12, wherein the second portion exists adjacent a central portion of the recording material with respect to a movement direction of said image bearing member.

14. An image forming apparatus, comprising:

an image bearing member movable along an endless path;

primary charging means for electrically charging said image bearing member for formation of latent image thereon;

developing means for developing the latent image with toner into a toner image;

recording material carrying means for carrying the recording material;

transfer charging means for transferring the toner image onto the recording material carried on said recording material carrying means;

discharging means, disposed between said transfer charging means and said primary charging means and actable directly on said image bearing member not through the recording material after the toner image is transferred from said image bearing member to the recording material, for effecting electric discharge biased to a polarity opposite to a charging polarity of said transfer charging means, wherein a degree of the bias to the opposite polarity is larger for a first portion of said image bearing member corresponding to a trailing edge of the recording material than for a second portion which is different from the first portion.

15. An apparatus according to claim 14, wherein said discharging means is supplied with a DC voltage which is higher when the first portion is at a discharge position where said discharging means is actable than when the second portion is at the discharging position.

16. An apparatus according to claim 15, wherein said discharging means is supplied with a DC voltage only when the first portion is at the discharging position.

17. An apparatus according to claim 15, wherein said discharging means is supplied with an AC voltage component and a DC voltage component.

18. An apparatus according to claim 17, wherein said discharging means is supplied with both of the AC voltage component and the DC voltage component when the first portion is at the discharging position, and said discharging means is supplied only with the AC voltage component when the second portion is at the discharging position.

19. An apparatus according to claim 14, further comprising control means for controlling the degree of bias in accordance with an ambient condition under which said apparatus is operated.

20. An apparatus according to claim 19, further comprising detecting means for detecting a temperature and/or humidity as the ambient condition.

21. An apparatus according to claim 14, further comprising cleaning means for removing residual toner from said image bearing member after an image transfer operation by said transfer charging means, and said discharging means is disposed between said transfer charging means and said cleaning means.

22. An apparatus according to claim 14, wherein said image bearing member has a photosensitive layer of organic photoconductor.

23. An apparatus according to claim 14 or 22, wherein said transfer charging means has a charging polarity which is opposite to a charging polarity of said primary charging means.

24. An apparatus according to claim 23, wherein a polarity of electric charge constituting the latent image is the same as a charge polarity of the toner.

25. An apparatus according to claim 14, wherein the first portion of said image bearing member extends from a portion of said image bearing member which corresponds to the trailing edge of the recording material at the time of image transfer operation by said transfer charging means, toward upstream and downstream with respect to a movement direction of said image bearing member.

26. An apparatus according to claim 14 or 25, wherein the second portion exists adjacent a central portion of the recording material with respect to a movement direction of said image bearing member.

27. An apparatus according to claim 14, wherein said recording material carrying means includes a dielectric member for carrying the recording material.

28. An apparatus according to claim 27, wherein the dielectric member is in the form of a sheet.

29. An apparatus according to claim 14, wherein said developing means develops the latent images with different color toners which are transferred onto the same recording material by said transfer charging means.

30. An apparatus according to claim 29, wherein the toner images transferred onto the same transfer material are mixed to provide a full-color toner image.

31. An apparatus according to claim 14, wherein said recording material carrying means is movable along an endless path.

32. An image forming apparatus, comprising:

an image bearing member movable along an endless path;

primary charging means for electrically charging said image bearing member for formation of a latent image thereon;

developing means for developing the latent image with toner into a toner image;

transfer charging means for transferring the toner image onto the recording material;

discharging means, disposed between said transfer charging means and said primary charging means and actable directly on said image bearing member not through said recording material after an image transfer operation by said transfer charging means, for effecting discharge on said image bearing member, wherein said discharging means is differently actable on a first portion of said image bearing member corresponding to a trailing edge of the recording material than on a second portion thereof which is different from the first portion.

33. An apparatus according to claim 32, wherein said discharging means is supplied with an AC voltage.

34. An apparatus according to claim 33, wherein said discharging means is supplied with a DC voltage component and an AC voltage component.

35. An apparatus according to claim 32, further comprising control means for controlling an amount of discharge by said discharging means in accordance with an ambient condition under which said apparatus is operated.

36. An apparatus according to claim 35, further comprising detecting means for detecting temperature and/or humidity as the ambient conditions.

37. An apparatus according to claim 32, further comprising cleaning means for removing residual toner from said image bearing member after an image transfer operation by said transfer charging means, and said discharging means is disposed between said transfer charging means and said cleaning means.

38. An apparatus according to claim 32, wherein said image bearing member has a photosensitive layer of organic photoconductor.

39. An apparatus according to claim 32 or 38, wherein said transfer charging means has a charging polarity which is opposite to a charging polarity of said primary charging means.

40. An apparatus according to claim 39, wherein a polarity of electric charge constituting the latent image is the same as a charge polarity of the toner.

41. An apparatus according to claim 32, wherein the first portion of said image bearing member extends from a portion of said image bearing member which corresponds to the trailing edge of the recording material at the time of image transfer operation by said transfer charging means, toward upstream and downstream with respect to a movement direction of said image bearing member.

42. An apparatus according to claim 32 or 41, wherein the second portion exists adjacent a central portion of the recording material with respect to a movement direction of said image bearing member.

43. An apparatus according to claim 32, further comprising recording material carrying means for carrying the recording material during the transfer operation, wherein said recording material carrying means includes a dielectric member for carrying the recording mateiral.

44. An apparatus according to claim 43, wherein the dielectric member is in the form of a sheet.

45. An apparatus according to claim 32, wherein said developing means develops the latent images with different color toners which are transferred onto the said recording material by said transfer charging means.

46. An apparatus according to claim 45, wherein the toner images transferred onto the same transfer material are mixed to provide a full-color toner image.

47. An apparatus according to claim 32, wherein said recording material carrying means is movable along an endless path.

48. An apparatus according to claim 32, wherein said discharging means is effective to remove electric charge remaining on said image bearing member after an image transfer operation by said transfer charging means.

* * * * *

UNITED STATES PATENT AND TRADEMARK OFFICE

CERTIFICATE OF CORRECTION

PATENT NO. : 5,049,934

DATED : September 17, 1991

INVENTOR(S) : RIE SAITO

It is certified that error appears in the above-identified patent and that said Letters Patent is hereby corrected as shown below:

COLUMN 5

Line 30, "sheet o" should read --sheet or--.

COLUMN 7

Line 53, "no" should read --on--.

COLUMN 8

Line 13, "sued," should read --used,--.

COLUMN 12

Line 33, "said" should read --same--.

Signed and Sealed this

Sixth Day of July, 1993

Attest:

Michael K. Kirk

MICHAEL K. KIRK

Attesting Officer

Acting Commissioner of Patents and Trademarks